US007458740B2

(12) United States Patent
Wolters

(10) Patent No.: US 7,458,740 B2
(45) Date of Patent: Dec. 2, 2008

(54) PRINTER AND SUPPLY UNIT FOR USE IN THE PRINTER

(75) Inventor: Franciscus J. W. M. Wolters, Nijmegen (NL)

(73) Assignee: OCE-Technologies B.V., Venlo (NL)

( * ) Notice: Subject to any disclaimer, the term of this patent is extended or adjusted under 35 U.S.C. 154(b) by 0 days.

(21) Appl. No.: 11/269,566

(22) Filed: Nov. 9, 2005

(65) Prior Publication Data

US 2006/0104699 A1 May 18, 2006

(30) Foreign Application Priority Data

Nov. 12, 2004 (NL) ..... 1027495

(51) Int. Cl.
*B41J 15/04* (2006.01)
*B41J 15/20* (2006.01)
*B65H 5/28* (2006.01)

(52) U.S. Cl. ..... 400/613; 271/9.06

(58) Field of Classification Search ..... 400/613; 271/259, 9.06

See application file for complete search history.

(56) References Cited

U.S. PATENT DOCUMENTS 4,265,440 A * 5/1981 Shibazaki et al. ..... 271/9.06
4,852,785 A * 8/1989 Bettendorf et al. ..... 226/42
4,885,613 A * 12/1989 Kudoh ..... 399/23
4,969,016 A * 11/1990 Kudoh ..... 399/18
5,237,378 A * 8/1993 McEwen ..... 399/21
5,257,567 A * 11/1993 Walker et al. ..... 83/74
5,820,067 A * 10/1998 Orbons et al. ..... 242/560
6,400,854 B1 * 6/2002 Kudoh ..... 382/317
7,120,381 B2 * 10/2006 Matsuoka ..... 399/385
7,123,278 B2 * 10/2006 Kudou ..... 347/130
2002/0192001 A1 * 12/2002 McIntyre et al. ..... 400/583
2003/0123915 A1 * 7/2003 Klinefelter et al. ..... 400/237

FOREIGN PATENT DOCUMENTS

EP 0 762 225 A1 3/1997

* cited by examiner

*Primary Examiner*—Edward Lefkowitz
*Assistant Examiner*—Jonathan Dunlap
(74) *Attorney, Agent, or Firm*—Birch, Stewart, Kolasch and Birch, LLP

(57) ABSTRACT

The present invention relates to a printer which includes a print unit, a supply unit for the supply of substrate, said supply unit containing a first holder for rotatably receiving a first web of a first substrate wound into a roll, and a second holder for rotatably receiving a second web of a second substrate wound into a roll, a first motor for driving the first roll and a second motor for driving the second roll, an actuating unit for actuating the motors and a switch for connecting the actuating unit to the first or second motor, and a control unit, by means of which the switch connects the actuating unit to the first motor when the printer is configured for printing a first substrate, and the switch connects the actuating unit to the second motor when the printer is configured for printing the second substrate.

7 Claims, 4 Drawing Sheets

PRINTER AND SUPPLY UNIT FOR USE IN THE PRINTER

BACKGROUND OF THE INVENTION

The present invention relates to a printer comprising a print unit, and a supply unit for the supply of substrate, the supply unit including a first holder for rotatably receiving a first web of a first substrate wound into a roll, and a second holder for rotatably receiving a second web of a second substrate wound into a roll. The invention also relates to a supply unit suitable for use in the printer.

In order to print an image on the first substrate with the printer, the first roll is partially unwound and the free end of the unwound web is brought into a transport path of the printer. Using the transport path, the unwound web of substrate is transported further in the printer to the print unit which, in one embodiment, is an inkjet print unit. By means of the print unit the image is printed on the substrate, whereafter the part of the web on which this image is printed is cut off from the rest of the web. A following part of the web can then be printed by feeding this part along the print unit.

In order to print an image on the second substrate, the part of the web of the first substrate is first wound back on to the roll, so that the transport path is freed. A part of the web is then unwound from the second roll and the free part of this web is brought into the transport path of the printer. By now unwinding the second roll and further transporting the unwound part of the web to the print unit, it is also possible to print the second substrate.

SUMMARY OF THE INVENTION

The object of the present invention is to provide a printer wherein the delivery of the substrate for printing by unwinding from a roll of the substrate in a supply unit suitable for holding two rolls, can take place in a reliable, reproducible and economically attractive manner.

In the printer of the present invention, each of the receiving members is provided with its own motor for rotatably driving the rolls. There is, however, only one actuating unit, for example a PCB provided with adequate electric components, to actuate the two motors. By means of a control unit, for example a central processor in the printer, the actuating unit is selectively connected to the first or second motor. If it is connected to the first motor, the motor can be driven to rotate the first roll and in so doing unwind from the roll the web of substrate corresponding thereto. This web can be transported by means of further transport means in the printer to the print unit for the printing thereof. If the second substrate has to be printed, then the second motor corresponding to the second roll must be driven to unwind the second roll. For this purpose, the actuating unit is connected to the second motor by means of a switch. By the use of one actuator unit for both motors there are fewer variables influencing the unwinding of the roll and hence the transport of the unwound web of substrate. In addition, the reliability of the printer increases by the fact that it is possible to dispense with a second actuating unit. The switch provided, which can incidentally be of any type, hence mechanical, electrical, via radio waves, or in any form whatsoever, ensures that the actuating unit is functionally connected to either the first or the second motor, so that the same can always be driven at least during the unwinding of the roll.

In one embodiment, the actuating unit forms part of the supply unit. This embodiment makes it simpler to construct the supply unit as in independent module which can be coupled to the other parts of the printer. This offers the possibility of equipping the printer with different types of supply units, depending on the specific requirements of the user of the printer.

In one embodiment, the printer includes two of the supply units as defined hereinbefore, and a central control unit by means of which the switches of the two supply units can be controlled. In this embodiment, control of the switch takes place by means of the central control unit. In these conditions it is advantageous to use the fact that many printers have a central control unit for the correct control of all of the subfunctions in the printer involved in a specific print job. This control unit thus frequently has information from which it is possible to derive what type of substrate is to be printed. To print the same, therefore, the roll on which this material is wound must also be driven. An adequate signal can be given from the control unit such that the switch connects the actuating unit to the corresponding motor, at least when the roll actually has to be driven.

In one embodiment, the first and second motors are electric motors. In another embodiment, the printer is provided with a means for keeping the electric circuit for actuation of the first motor closed for as long as the first roll is rotating and the electric circuit for actuating the second motor closed as long as the second roll is rotating. This means may, for example, be a set of electronic components, which may or may not be controlled by software. The advantage of this embodiment is that it is possible to avoid the build-up of excessive voltages in the circuits containing the motors. These voltages may occur if the roll continues to rotate for some time after the motor has been actively driven, for example because the roll, under the influence of its own mass inertia, does not stop immediately after the switching off of the motor. Since the electric motor is then driven mechanically, it will act as a generator. If the switch has then interrupted the circuit for actuating this electric motor, it is possible that considerable voltages can build up in that part of the circuit. As a result, some components may be damaged. To avoid this, the means of this embodiment ensures that the circuit for actuating an electric motor remains closed as long as the roll corresponding thereto rotates.

The present invention also relates to a supply unit for the supply of substrate suitable for use in a printer, said supply unit including a first holder for rotatably receiving a first web of a first substrate wound into a roll, and a second holder for rotatably receiving a second web of a second substrate wound into a roll, a first motor for driving the first roll and a second motor for driving the second roll, an actuating unit for actuating the motors and a switch for connecting the actuating unit to the first or second motor, wherein the switch selectively connects the actuating unit to the first or second motor by means of a control unit. A supply unit of this kind can advantageously be used, for example as a detachable module in a printer which has to be suitable for many different markets.

BRIEF DESCRIPTION OF THE DRAWINGS

The invention will now be explained with reference to the following drawings, wherein.

DETAILED DESCRIPTION OF THE INVENTION

Figure 1:
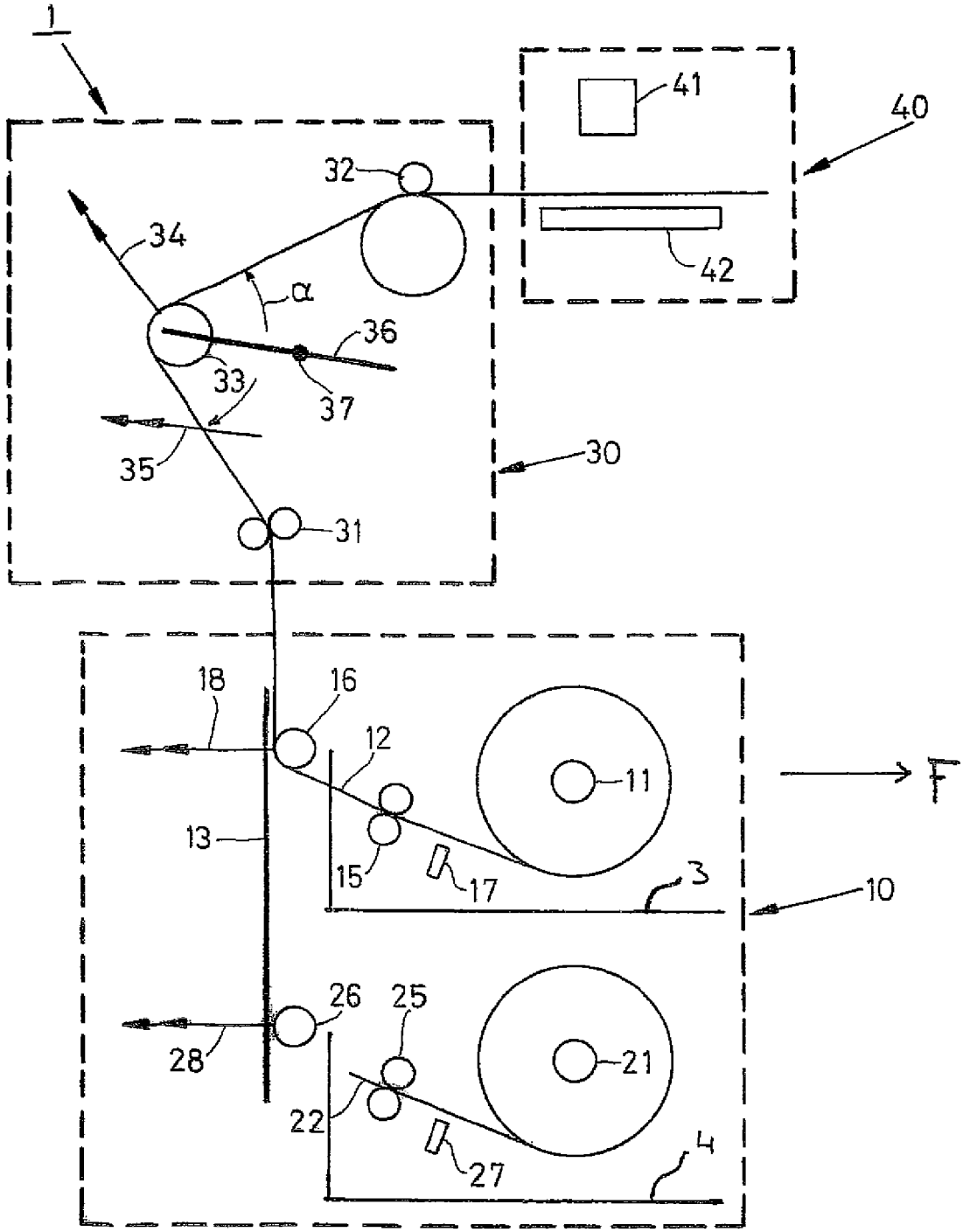
FIG. 1 is a diagram showing a printer according to the present invention.

FIG. 1 is a diagram showing a printer according to the present invention. This printer is provided with a supply unit 10 which serves for the storage and delivery of the substrate for printing. In addition, the printer includes transport unit 30 which transports the substrate from the supply unit 10 to the print unit 40. Unit 30 also ensures accurate positioning of the substrate in the print zone formed between the print surface 42 and the inkjet printhead 41. In this embodiment, print unit 40 is a conventional engine containing printhead 41 which is constructed from a number of loose sub-heads, each for one of the colors black, cyan, magenta and yellow. A printhead of this type is described in detail in European patent application EP 1 378 360. Printhead 41 has only a limited print range so that it is necessary to print the image on the substrate in various sub-images. For this purpose, the substrate is transported in increments in each case in the transit direction (subscan direction) so that a new part of the substrate can be printed in the print zone. In the example illustrated, the substrate 12 originates from core 11 containing a roll of substrate, which roll is situated in the supply unit 10. The roll is received in drawer 3 of the supply unit. A web of substrate is wound on the core 11 of the roll and has a length of 200 meters. To accommodate the roll in the printer the drawer 3 is provided with a holder (not shown) to support the core in the surroundings of its ends. As a result the roll can be accommodated rotatably in the drawer. The holder includes two support members received in side plates of the drawer, the support members being brought into co-operative connection with the ends of the roll. In this embodiment the supply unit is provided with a second drawer 4 to receive a following roll mounted on a core 21 on which a substrate 22 is wound. This substrate 22 can also be delivered by the supply unit for printing. The drawers can be pushed out of the supply unit 10 in the indicated direction F for the withdrawal of the rolls and/or insertion of new rolls. For the transport of the substrate, core 11 is operatively connected to transport means 15, which in this case is a pair of rollers between which a transport nip is formed. A sensor 17 is mounted upstream of the transport means 15 to determine whether there is still substrate on the roll in the relevant holder. The holder is provided with transport means 25 for the transport of a substrate originating from the other roll. Upstream of this means the supply holder is provided with sensor 27 which has the same action as sensor 17. The supply holder is provided with guide elements 16 and 26 to guide the substrates 12 and 22 respectively to the transport unit 30. Transit path 13 is located downstream of these guide elements. This transit path is used both for the transport of substrate 12 and the transport of substrate 22.

A substrate leaving the supply unit 10, substrate 12 in this example, is engaged by transport means 31 of the transport unit 30. This transport means transports the substrate via a guide element 33 on to the second transport means 32 of the transport unit 30. The transport means 32 engages the substrate, and transports it on to the print unit 40. Thus the printer is configured to print substrate 12. For configuration to a print substrate 22 it is necessary in this case to wind substrate 12 back on the core 11 so that the free end finally leaves transit path 13. Roller pair 15 then still holds the substrate 12 fast. Substrate 22 can then be spooled over guide element 26 by the drive of the roller pair 25 until nip 31 is reached whereupon the latter takes over the drive for the substrate and spools the substrate onto nip 32 for reaching the print surface 42. The printer is then configured to print substrate 22.

The guide elements 16 and 26 are in this example rollers extending parallel to the transport means 15,31 and 25,31, respectively. They are basically stationary rollers (i.e., they cannot rotate about their axial axis). The guide elements are so disposed in the supply unit that they can each rotate, at least through a limited angle, about an axis. In the drawing, the rotational axis 18 of element 16 is shown, and also the rotational axis 28 of element 26. These rotational axes are perpendicular to the axes of the guide elements and intersect the middle of these elements.

Guide element 33 of transport unit 30, which element extends substantially parallel to the transport means 31 and 32, is also so disposed that it can rotate about an axis perpendicular to the axial direction of the guide element. The axis is shown by reference 34 and intersects the middle of guide element 33. Since element 33 in this embodiment is a co-rotating roller, the substrate remains substantially stationary with respect to the surface of this guide element. Element 33 is also suspended so that it can rotate about axis 35, which axis 35 extends parallel to the bisector 36 of the angle $\alpha$ over which the substrate is fed from means 31 to means 32, The axis 35 intersects the middle of the substrate web at a distance of about 1 meter from the guide element itself.

Guide element 33 is movable from a first position in which said element is situated in FIG. 1, to a second position in which the center of this element coincides with location 37. In the first position, the distance over which substrate 12 extends between transport means 31 and transport means 32 is maximum. In the second position this distance is minimal. Use is made of this during the transport of the substrate to print unit 40. Since the substrate must in each case be moved over a relatively small distance (typically 5 to 10 cm), it is advantageous for this to take place relatively rapidly. The massive inertia of roll 11, certainly when it is provided with the maximum quantity of substrate, is relatively high however. For this reason, displacement while maintaining the configuration shown for transport means and guide elements would take relatively a considerable amount of time. To counteract this problem, transport means 31 is accelerated much more slowly than transport means 32. However, in order to ensure sufficient supply of substrate to transport means 32, the guide element 33 is moved in the direction of location 37.

Figure 2:
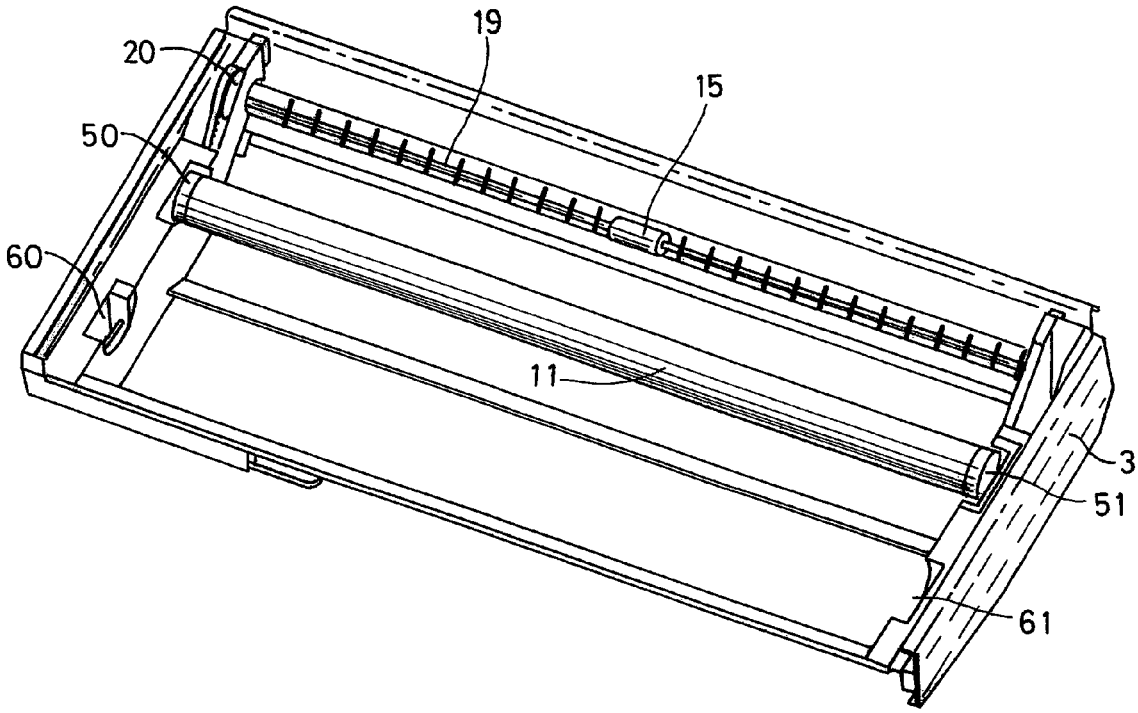
FIG. 2 is a diagram showing a drawer of a supply unit of this printer.

FIG. 2 diagrammatically illustrates an alternative embodiment of the drawer 3. In this case, the drawer is provided with two holders to receive two individual cores. The first holder comprises a first pair of support members 50 and 51. The second holder comprises a second pair of support members 60 and 61. In the drawing, the core 11 is received in the first holder. When this drawer is in use in a printer the core present therein will be provided with a substrate wound thereon (not shown). To unwind the substrate, the core is rotatably accommodated in the holder. Roller pair 15, of which only one roller is visible in the drawing, also forms part of the drawer. The roller illustrated is mounted on shaft 19 which can be driven by gearwheel 20.

The distance between the support members is such that a user can readily place a roll in the holder by substantially making the ends of the core coincide with the positions of the two support members. After the roll has been placed in the holder, it is automatically brought by a number of resilient elements (not shown) into a substantially fixed position with respect to the print surface.

Figure 3:
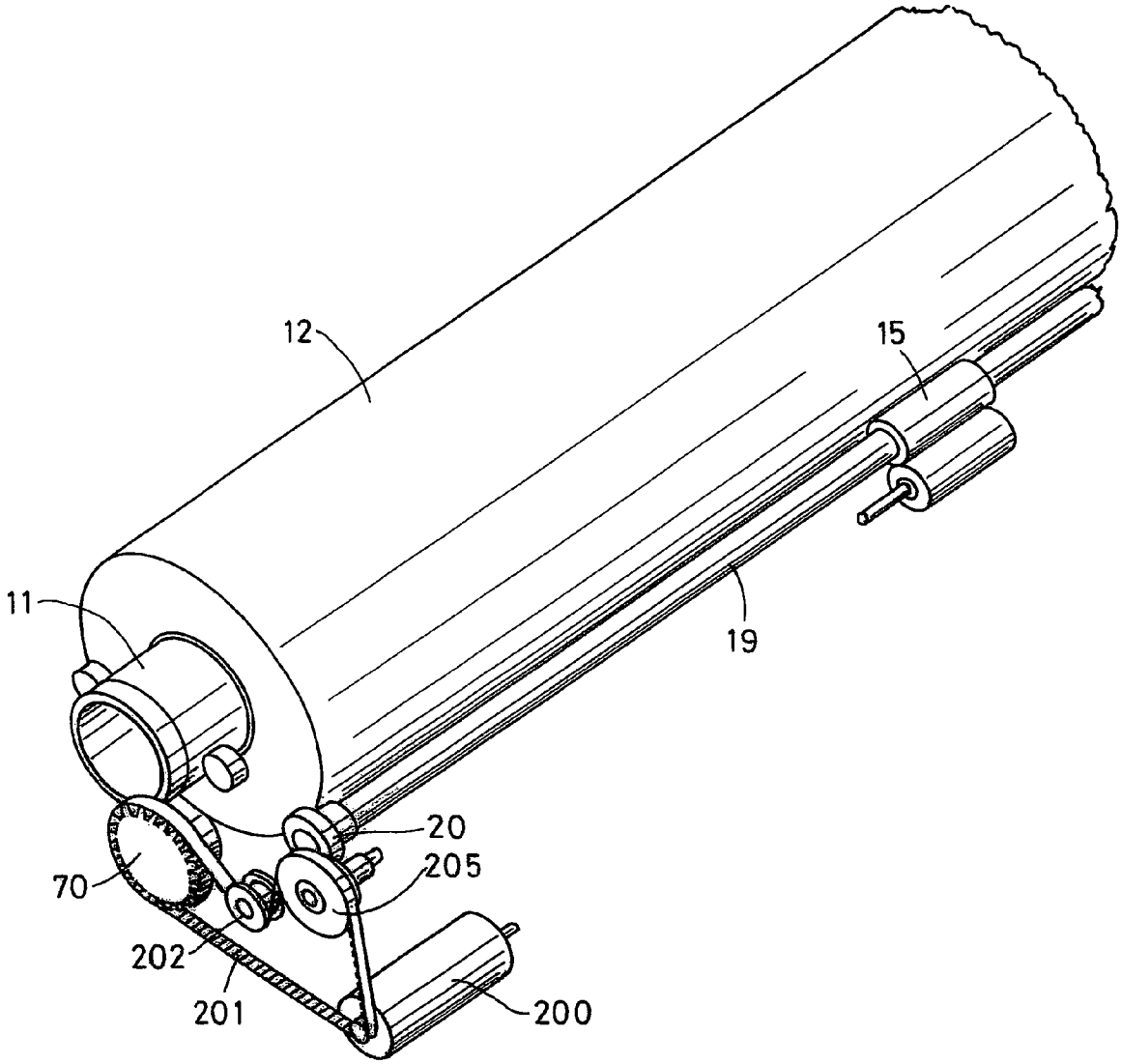
FIG. 3 diagrammatically shows some of the components which ensure transport of the substrate.

FIG. 3 diagrammatically shows a number of components of the supply unit ensuring transport of a substrate from a roll to the print surface. For clarification, only those parts corresponding to one roll are shown. In the supply unit according to this embodiment, the drawer in which the roll is situated also comprises a second holder (not shown) suitable for receiving a roll of substrate. This second holder comprises the same components as shown in the drawing.

The roll illustrated includes substrate 12 rolled on core 11. An electric motor 200 is provided which is operatively connected via a drive belt 201 to gearwheel 70 and wheel 205. Belt 201 is trained over tensioning element 202. When the electric motor is switched on a driving force is transmitted to the wheels 70 and 205. It is thus possible to drive the core 11 of the roll, which includes the core and the substrate 12 wound thereon, and also wheel 20 connected to shaft 19 on which one roller of the roller pair 15 is mounted. To transport the substrate 12 to print surface 42 (not shown) the free end of the substrate must be brought into the transport nip formed by roller pair 15, after which the roller pair is driven via a shaft 19. During transport through this nip to the print surface, no power from the electric motor is transmitted to the core since a unidirectional bearing (not shown) is used. When the substrate is spooled back to the core and rewound thereon, the core 11 and shaft 19 are driven. By means of a slipping clutch (not shown) between the core 11 and the electric motor 200, the winding speed at the roll is made equal to the speed of feed of the substrate at the roller pair 15.

Figure 4:
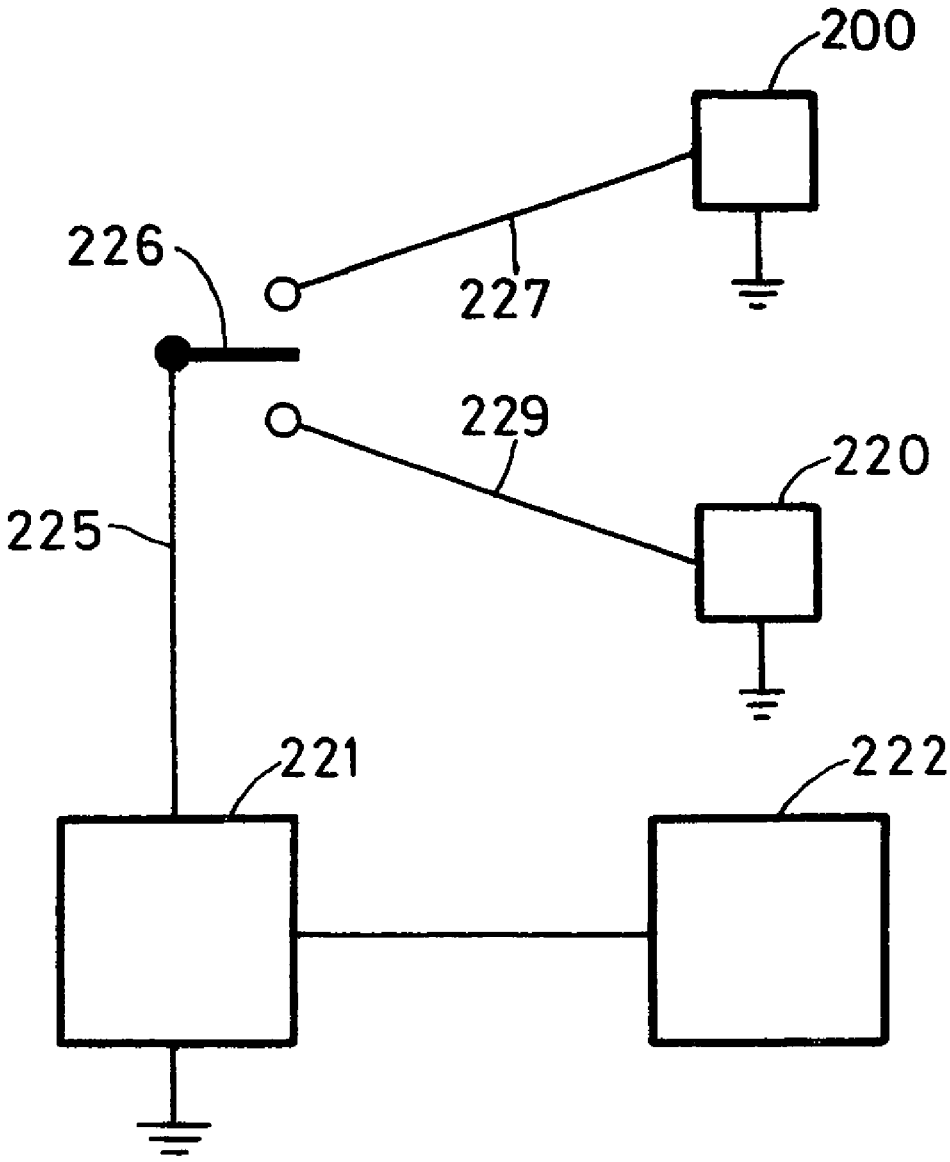
FIG. 4 is a diagram showing a circuit for use in a printer according to the invention.

FIG. 4 diagrammatically shows a circuit for use in a printer according to the present invention. Actuating unit 221 is an electronic element (printed circuit board) provided with components for actuating an electric motor. In the example illustrated, the circuit is provided with two electric motors 200 and 220. The circuit is also provided with a switch 226 which can connect the motors selectively to actuating unit 221 via line 225. The switch can, for example, be constructed as a two or three state switch and be integrated in element 221. Unit 221, the two motors 200 and 220 and the switch 226 in this embodiment form part of one drawer in the supply unit. To connect the actuating unit to motor 200, the switch is operatively connected to line 227. To connect the element with motor 220 the switch is operatively connected to line 229. Connection of unit 221 to motor 200 takes place when the printer is configured for printing the substrate corresponding to motor 200 (i.e., the substrate on the core which can be driven by means of motor 200). This connection need not be kept in place continuously. It is sufficient for this connection to take place during the time that the substrate actively has to be passed in the sub-scan direction with actuation of motor 200. In an alternative embodiment, the connection takes place for the entire period that the printer is configured for printing the corresponding substrate, and the motor is actuated only when the substrate has to be actively fed. This embodiment has the advantage that a build up of considerable voltages by the mechanical drive of the motor can be prevented.

The method of switching and actuating with unit 221 takes place under the supervision and control of the central processor unit 222, which is located centrally in the printer, for example in a separate controller unit. With the actuation of this processor the motors are connected to unit 221, and actuated. In this embodiment, the processor 222 is the element that controls all the processes in the printer. It will be clear to the skilled man that the functionality of this processor can also be present in the printer in distributed form. Similarly, the components of unit 221 can be mounted on one printed circuit board or be distributed over various locations in the printer. Components can be constructed in hardware and software as sufficiently known from the prior art.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A printer which consists essentially of a print unit, a supply unit for a supply of substrate, and a transport unit deposed between the supply unit and the print unit, said transport unit controlling the tension in the web, wherein said supply unit includes a first holder for rotatably receiving a first web of a first substrate wound into a first roll, and a second holder for rotatably receiving a second web of a second substrate wound into a second roll, a first motor directly operatively connected to the first roll for driving the first roll such that the first web of the first substrate is unwounded from the first roll a second motor directly operatively connected with the second roll for driving the second roll such that the second web of the second substrate is unwounded from the second roll, an actuating unit for actuating the motors and a common switch for selectively connecting the actuating unit to the first or second motor, and a control unit, by means of which the switch connects the actuating unit to the first motor when the printer is configured for printing a first substrate, and the switch connects the actuating unit to the second motor when the printer is configured for printing the second substrate, whereby mutual exclusiveness of activation is achieved.

2. The printer according to claim 1, wherein the actuating unit forms part of the supply unit.

3. The printer according to claim 1, wherein the printer includes two supply units, whereby the control unit controls the switches of the two supply units.

4. The printer according to claim 1, wherein the first and second motors are electric motors.

5. The printer according to claim 4, wherein the printer is provided with a means for keeping the electric circuit for actuation of the first motor closed for as long as the first roll is rotating and the electric circuit for actuating the second motor closed as long as the second roll is rotating.

6. The printer of claim 1, wherein said printer is an ink jet printer.

7. The printer of claim 1, wherein the transport unit includes transportation means in combination with movable guide elements for controlling the tension in the web.

* * * * *